US009873062B2

(12) United States Patent
Purns

(10) Patent No.: US 9,873,062 B2
(45) Date of Patent: Jan. 23, 2018

(54) MODULE AND MODULAR SYSTEM

(71) Applicant: Sven Purns, Purkersdorf (AT)

(72) Inventor: Sven Purns, Purkersdorf (AT)

( * ) Notice: Subject to any disclaimer, the term of this patent is extended or adjusted under 35 U.S.C. 154(b) by 0 days.

(21) Appl. No.: 15/116,247

(22) PCT Filed: Jan. 29, 2015

(86) PCT No.: PCT/EP2015/051792

§ 371 (c)(1),
(2) Date: Sep. 8, 2016

(87) PCT Pub. No.: WO2015/114044

PCT Pub. Date: Aug. 6, 2015

(65) Prior Publication Data

US 2016/0367906 A1 Dec. 22, 2016

(30) Foreign Application Priority Data

Feb. 3, 2014 (AT) ..... 47/2014
Jun. 2, 2014 (AT) ..... 434/2014

(51) Int. Cl.
*A63H 33/04* (2006.01)
*A63H 33/06* (2006.01)

(52) U.S. Cl.
CPC ..... *A63H 33/046* (2013.01); *A63H 33/06* (2013.01)

(58) Field of Classification Search
CPC ..... A63H 33/046
USPC ..... 446/92, 129, 131
See application file for complete search history.

(56) References Cited

U.S. PATENT DOCUMENTS 2,795,893 A * 6/1957 Vayo ..... A63H 33/046 446/92
2,939,243 A * 6/1960 Duggar ..... A63H 33/046 273/157 R
5,409,236 A * 4/1995 Therrien ..... A63F 9/1204 273/156
5,746,638 A * 5/1998 Shiraishi ..... A63H 33/046 446/131
6,749,480 B1 * 6/2004 Hunts ..... A63H 33/046 446/85
7,160,170 B2 * 1/2007 Yoon ..... A63H 33/046 273/156

(Continued)

FOREIGN PATENT DOCUMENTS

CN 101610823 A 12/2009
EP 2055363 A1 5/2009

(Continued)

*Primary Examiner* — Alexander Niconovich
(74) *Attorney, Agent, or Firm* — Laurence A. Greenberg; Werner H. Stemer; Ralph E. Locher

(57) ABSTRACT

A modular system has two or more modules, wherein each module is delimited by one or more side surfaces and has at least one magnet chamber with a magnet body provided in the magnet chamber, wherein the magnet body is provided rotatably in the magnet chamber, and wherein the magnet body has a shell surface in the shape of a rotary body or cylinder, wherein the magnet body has a greater dimension along the rotary body axis than perpendicular to the rotary body axis, such that the magnet body has an elongate form, and in that the magnet body has two poles of different magnetic polarity, said poles extending adjacent to one another along the rotary body axis.

19 Claims, 2 Drawing Sheets

(56) References Cited

U.S. PATENT DOCUMENTS

| | | | | |
|---|---|---|---|---|
| 7,320,633 | B2 * | 1/2008 | Park | A63H 33/046 446/131 |
| 7,413,493 | B2 * | 8/2008 | Toht | A63H 33/046 273/156 |
| 7,887,056 | B2 * | 2/2011 | Tenorio | A63F 9/1208 273/156 |
| 8,070,550 | B2 * | 12/2011 | Song | A63H 33/046 446/129 |
| 8,128,452 | B2 * | 3/2012 | Kim | A63H 33/046 446/129 |
| 8,850,683 | B2 * | 10/2014 | Haughey | A63H 33/046 29/428 |
| 9,227,147 | B2 * | 1/2016 | Kim | A63H 33/046 |
| 9,433,871 | B2 * | 9/2016 | Park | A63H 33/102 |
| 9,643,100 | B2 * | 5/2017 | Fein | A63H 33/046 |
| 2006/0139134 | A1 | 6/2006 | Hunts | |
| 2010/0022158 | A1 * | 1/2010 | Kim | A63H 33/06 446/92 |
| 2010/0056014 | A1 * | 3/2010 | Tenorio | A63F 9/1204 446/92 |
| 2010/0087119 | A1 * | 4/2010 | Vicentelli | A63H 33/046 446/92 |
| 2010/0120322 | A1 * | 5/2010 | Vicentelli | A63H 33/046 446/92 |
| 2012/0270465 | A1 * | 10/2012 | Park | A63H 33/046 446/129 |
| 2012/0309259 | A1 * | 12/2012 | Mak | A63H 33/046 446/92 |
| 2014/0213139 | A1 * | 7/2014 | Ferguson | A63H 33/046 446/92 |
| 2014/0302741 | A1 * | 10/2014 | Whittaker | A63H 33/046 446/92 |
| 2015/0065007 | A1 * | 3/2015 | Klepper | A63H 33/046 446/92 |

FOREIGN PATENT DOCUMENTS

| | | | |
|---|---|---|---|
| EP | 2127714 | A1 | 12/2009 |
| KR | 100954429 | B1 | 4/2010 |
| WO | 2008043535 | A1 | 4/2008 |

* cited by examiner

MODULE AND MODULAR SYSTEM

BACKGROUND OF THE INVENTION

Field of the Invention

The invention relates to a building block and a building block system, wherein the building block is delimited by one or multiple faces and comprises at least one magnet chamber having a magnet body provided in the magnet chamber.

Building blocks and toy building blocks and systems that comprise multiple building blocks have been known for a long time and advertised in different embodiments.

By way of example, building block sets are known whose building blocks comprise protrusions and free areas, wherein the protrusions of one building block can be inserted into the free areas of a further building block. It is a disadvantage of this building block system that the building blocks can only be connected to one another in a specific orientation. Thus, the protrusions cannot be plugged together with other protrusions of other building blocks. Also, the receiving devices are not suitable for being connected to the receiving devices of other blocks.

Moreover, when building complex figures, a plurality of differently shaped blocks are required in order to be able to build the desired shape by means of plugging the blocks together along the predetermined orientation.

BRIEF SUMMARY OF THE INVENTION

It is thus the object of the invention to provide a building block and a building block system that renders it possible to plug together complex figures in a simple manner. This includes in particular that the building blocks can be connected to one another in different orientations. Moreover, it is where appropriate an object of the invention that when connecting the building blocks, where appropriate, an automatic position centering occurs in order to be able to build clear geometric shapes despite the simple connectability. In all embodiments, the magnet bodies can be mounted with clearance in the magnet chambers.

The object is achieved in accordance with the invention in particular by means of the feature combinations of the independent claims.

Where appropriate, the invention relates to a building block that is delimited by means of one or multiple faces and comprises at least one magnet chamber having a magnet body that is provided in the magnet chamber, wherein the magnet body is provided in such a manner as to be able to rotate in the magnet chamber, wherein the magnet body comprises a peripheral surface that is embodied in the shape of a cylinder or rotation body, wherein the magnet body has a greater dimension along the rotation body axis than in a perpendicular manner with respect to the rotation body axis, so that the magnet body has an elongated shape, and that the magnet body comprises two poles that have a different magnetic polarity and extend adjacent to one another along the rotation body axis. Where appropriate, it is provided that the magnet body is arranged in the magnet chamber in such a manner as to be able to rotate about two axes of the magnet body that deviate from one another, wherein the axes are in particular perpendicular with respect to one another.

Where appropriate, it is provided that the two poles extend in each case on one side of the rotation body axis of the magnet body as far as the outside of the magnet body so that the rotation body axis extends essentially between the two poles.

Where appropriate, it is provided that one axis about which the magnet body can rotate in the magnet chamber coincides with the rotation body axis of the magnet body.

Where appropriate, it is provided that the axis about which the magnet body can rotate in the magnet chamber and that coincides with the rotation body axis is different from the normal with respect to the closest face of the building block and in particular extends parallel to the closest face of the building block so that by rotating the magnet body about the axis as desired one of the two poles can rotate in the direction of the face and the other pole can rotate in the direction of the interior of the building block. Where appropriate, it is provided that the magnet chamber is embodied in the shape of a cylinder, wherein the axis of rotation of the cylindrical magnet chamber extends essentially in a normal manner with respect to the closest face, that the diameter of the cylindrical magnet chamber is greater than or equal to the maximum dimension of the magnet body along the rotation body axis of the magnet body, and/or that the height of the cylindrical magnet chamber is greater than or equal to the maximum diameter of the magnet body as measured in a perpendicular manner with respect to the rotation body axis of the magnet body so that the magnet body can rotate in the magnet chamber about its rotation body axis and about an axis that is perpendicular with respect to the rotation body axis.

Where appropriate, it is provided that the magnet chamber is arranged in the interior of the building block close to a face, that a chamber wall is arranged between the magnet chamber and the face, wherein the magnetic field of the magnet body extends through the chamber wall and over and beyond the face as far as outside the building block.

Where appropriate, it is provided that the magnet body can rotate at least 45°, 60°, 90°, 120°, 180°, 270° or 360° about an axis or that the magnet body can rotate about an axis in an unrestricted manner, and that the magnet body can rotate in an unrestricted manner or cannot rotate 45°, 60°, 90°, 120°, 180°, 270°, 360° about a second axis.

Where appropriate, it is provided that the magnet body is guided and mounted in the magnet chamber in such a manner as to be able to a rotate or that the magnet body is guided and mounted in the magnet chamber in such a manner as to be able to rotate about two axes so that the magnet body can rotate in the magnet chamber about one or two axes but further degrees of freedom of movement of the magnet body in the magnet chamber are essentially blocked and that the guided mounting arrangement is provided with clearance where appropriate.

Where appropriate, it is provided that the faces extend or are planar in each case along one plane.

Where appropriate, it is provided that at least one, multiple or all face(s) are/is square-shaped.

Where appropriate, it is provided that two or more square-shaped faces are arranged in pairs in an orthogonal manner so that the building block is embodied in the shape of a cube or in the shape of a part of a cube, such as in particular a right prism that comprises a base face in the shape of a right-angled isosceles triangle whose limb length corresponds to the height of the prism.

Where appropriate, it is provided that multiple magnet chambers are provided with in each case one magnet body or that in each case a magnet chamber having in each case one magnet body is provided on multiple faces.

Where appropriate, it is provided that in each case a magnet chamber having in each case one magnet body is provided on all faces or on all square-shaped faces.

Where appropriate, it is provided that an axis or rotation of the magnet body in the magnet chamber extends essentially in a normal manner with respect to the closest outer face and where appropriate that this axis of rotation extends in a perpendicular manner with respect to the rotation body axis of the magnet body.

Where appropriate, it is provided that the magnet chamber is closed and in particular is separated from the outside by means of the chamber wall, in particular is separated in a water-tight manner so that one building block is formed with a magnet chamber that is essentially sealed with respect to the outside or with multiple magnet chambers that are essentially sealed with respect to the outside, and that the chamber wall is preferably a part of the base body of the building block that is embodied in one piece with a base body of the building block.

Where appropriate, the invention relates to a building block system comprising two or more building blocks in accordance with the present description, wherein a first building block comprises a first magnet chamber having a first magnet body that is provided in the first magnet chamber in such a manner as to be able to rotate, that a second building block comprises a second magnet chamber having a second magnet body that is provided in the second magnet chamber in such a manner as to be able to rotate, and/or wherein the first building block can be connected or is connected to the second building block by way of magnetic forces that act between the first magnet body and the second magnet body.

Where appropriate, it is provided that an axis of rotation of the first magnet body in the first magnet chamber of the first building block coincides with an axis of rotation of the second magnet body in the second magnet chamber of the second building block so that two building blocks that are connected by way of the first magnet body and the second magnet body can rotate with respect to one another whilst maintaining a constant magnetic holding force and in particular can rotate in a centered manner with respect to one another.

Where appropriate, it is provided that multiple building blocks can be connected or are connected to one another by way of in each case multiple magnet bodies that are provided in the magnet chambers.

Where appropriate, it is provided that two or more building blocks of the building block system are embodied with an identical shape.

Where appropriate, it is provided that the magnet bodies of two mutually connected faces of two building blocks point outwards in each case with only one of their poles, wherein the outwards-pointing pole of one building block and the outwards-pointing pole of the other building block have an opposite polarity, and/or that the orientation of the two magnet bodies is produced automatically by means of the magnetic forces of the magnet bodies.

It is preferred that the connection between two building blocks of the building block system is produced by way of magnetic forces. Thus, each building block preferably comprises at least one magnet chamber in which a magnet body is provided. If two building blocks are guided towards one another, the magnetic fields act over and beyond the faces of the building block and as a result come into operative contact with at least one further, adjacent magnet body of a further building block of the building block system. The building blocks are drawn towards one another and in particular are held against one another and connected to one another by virtue of the attractive force of the magnet bodies of the individual building blocks. It is preferred that each building block comprises multiple magnet bodies. By way of example, one building block comprises two faces, wherein in the region of two faces a magnet body is provided in each case. As a consequence, one building block can be connected by way of these two faces to other building blocks.

Where appropriate, the building block is embodied in the shape of a cube. This cube-shaped building block comprises six square-shaped faces. One magnet body is preferably provided in the case of each of the faces. As a consequence, this building block can be connected at its six faces to other building blocks.

Where appropriate, the building block is embodied in the shape of a part of a cube or a part of a cuboid. By way of example, the building block is embodied in the shape of a right prism having a base face that has the shape of a right-angled isosceles triangle. The side edges of the prism preferably have the identical length as the limb of the right-angled isosceles triangle. As a consequence, two faces of this building block are embodied in a square-shaped manner and by way of example by means of using a block building system can be connected in a congruent manner to equal sized square-shaped faces of cube-shaped building blocks.

Where appropriate, the building block has a tetrahedron shape or the shape of a prism having a base face that has the shape of an isosceles triangle or the shape of any other body. A magnet chamber having a magnet body provided therein is arranged at least in the region of a face of this building block.

In order to improve the versatile connectability of two building blocks to one another, it is intended to prevent that the magnet bodies of one building block are repelled by the magnet body of a further building block as a result of an identical polarity.

For this reason, it is preferred that the magnet bodies are provided in the magnet chamber in such a manner as to be able to rotate. As a consequence, the magnet bodies can be oriented automatically, in particular driven by means of the effect of two magnetic fields of two magnet bodies, said magnetic fields being in operative contact with one another so that the two magnet bodies attract one another and it is rendered possible to connect the two building blocks.

Where appropriate, the magnet body is arranged, guided and/or mounted in the magnet chamber in such a manner as to be able to rotate in the magnet chamber about two axes that deviate from one another. As a consequence, it is possible by way of example on one hand for the outwards-facing pole of the building block to rotate inwards. On the other hand, the orientation of the magnetic field can also be rotated.

Where appropriate, the magnet body is embodied in the shape of a rotation body, a sphere, a cylinder, a cube, a cuboid or a lamella.

In the case of a design in the shape of a rotation body, the magnet body can rotate in particular about the axis of rotation of the rotation body without being hindered by the magnet chamber. The magnet chamber can correspond essentially to a complementary shape of the magnet body, where appropriate with a certain amount of over-dimensioning.

In the case of magnet bodies that are embodied in the shape of a non-rotation body, such as by way of example in the case of cube-shaped magnet bodies, the magnet chamber comprises preferably such a shape that the magnet body can rotate freely or be guided in the magnet chamber and can orient itself automatically.

In accordance with a preferred embodiment, the magnet body is embodied in the shape of a rotation body, wherein it is preferred that the extension of the magnet body along the axis of rotation of the rotation body is greater than the maximum diameter. By way of example, the magnet body is embodied in the shape of a cylinder, wherein the height of the cylinder is greater than the diameter. It is preferred that in the case of this cylindrical or rotation body-shaped embodiment of the magnet body, the separation plane of the two poles is the plane in which the rotation body axis also lies. This means that, where appropriate, the separation plane extends along a longitudinal symmetrical axis of the magnet body. Consequently, two poles extend in this embodiment along the entire length of the rotation body. In the case of a cylindrical design by way of example two poles extend from the one top face to the other top face.

Where appropriate, the invention relates to a connecting device comprising at least one magnet body that is provided in a magnet chamber, wherein the magnet body and the magnet chamber are embodied according to any one of the patent claims, according to the description and/or according to the figures. So as to connect with a further connecting device, the further connecting device can be embodied in an identical manner as the other connecting device. It is preferred that the two connecting devices are provided on two independent but mutually connectable bodies.

Where appropriate, the invention relates to a building block system comprising two or multiple identically-shaped building blocks, wherein each building block comprises a base body and at least two connecting devices, wherein the base body corresponds essentially to a right prism that has a base face in the shape of a right-angled isosceles triangle, wherein a top face that is congruent with the base face is provided on the base body and wherein essentially square-shaped faces are provided on the base body, said square-shaped faces adjoining the base face at a right angle and adjoining one another at the two limbs of the base face and at the two limbs of the top face.

Where appropriate, it is provided that a connecting device is provided in each case on the square-shaped faces of each building block and it is possible by way of said connecting device to connect a first building block to a further, second building block in at least two positions that rotate with respect to one another 90° about a normal vector of the face.

Where appropriate, it is provided that the connecting devices of two building blocks by means of which they are connected and/or can be connected to one another comprise in each case a magnetic or magnetizable connecting body and/or a connecting body that is embodied as a magnet, wherein the magnetic field of the connecting body of the first building block is arranged in such a manner as to be able to rotate with respect to the magnetic field of the connecting body of the second building block.

Where appropriate, it is provided that the magnetic field of the connecting body of the first building block is arranged in such a manner as to be able to rotate with respect to the base body of the second building block, and that the magnetic field of the second building block is arranged in such a manner as to be able to rotate with respect to the base body of the second building block.

Where appropriate, it is provided that the connecting body is mounted in the base body in such a manner as to be able to rotate so that said connecting body can be automatically oriented depending upon the polarity of a magnetic field of a further connecting body to which said connecting body is to be connected.

Where appropriate, it is provided that the connecting body is embodied at least in sections in the shape of a rotation body or in particular comprises a spherical, conical or cylindrical section or that the connecting body is embodied in the shape of a sphere, cone or cylinder.

Where appropriate, it is provided that the connecting body is mounted in the base body and that an opening is provided so that the connecting body is accessible or visible from outside or that an opening is not provided so that the connecting body is neither directly nor indirectly visible or accessible from the outside.

Where appropriate, it is provided that the connecting body is embodied in the shape of a sphere and that the spherical connecting body is mounted with clearance in a chamber of the base body in such a manner as to be able to rotate about any axis of rotation.

Where appropriate, it is provided that a connecting device is provided on the third rectangular face, on the base face and/or on the top face of a triangular base body.

Where appropriate, it is provided that the connecting device comprises a connecting body that is connected to the base body in such a manner as to be able to rotate, wherein the axis of rotation corresponds preferably to a normal vector of the face on which the connecting device is provided.

Where appropriate, it is provided that the axis of rotation is arranged in the region of the middle of the respective face, preferably in the geometric center of the respective face.

Where appropriate, it is provided that the connecting body of the connecting device is fixedly connected to the base body in a translatory manner so that a relative movement of the connecting body with respect to the base body is possible within the scope of any manufacturing tolerances or of the provided clearance exclusively by means of rotating about one or multiple axes of rotation.

Where appropriate, it is provided that the base body is embodied as a hollow body.

Where appropriate, it is provided that the base body is composed of two identical half shells.

Where appropriate, it is provided that one connecting body is provided per building block face that is to be connected.

Where appropriate, it is provided that a first building block can be connected to a further, second building block by way of the connecting device in any rotational position, wherein the rotational position is a rotational position about a normal vector of the face of the first building block on which the connecting device is provided.

Where appropriate, it is provided that two building blocks that are connected by way of a connecting device can rotate with respect to one another about an or the axis of rotation, wherein the axis of rotation corresponds to a normal vector of the face on which the connecting device is provided and wherein the axis of rotation is arranged in the region of the middle of the respective face, preferably in the geometric center of the respective face.

Where appropriate, it is provided that each connecting device of a first building block can be connected to each connecting device of a further, second building block.

Where appropriate, it is provided that two mutually connected faces that are facing one another lie in a planar manner, in particular in a parallel manner, against one another.

In all embodiments, the connecting body is embodied preferably as a magnet body. In all embodiments, the connecting device preferably comprises a magnet chamber and a magnet body.

Where appropriate, the magnet body is embodied from a magnetic or magnetizable material. By way of example, the magnet body is embodied as a so-called neodymium magnet. By way of example, the magnet body is embodied to a great extent, in part or exclusively from the material NdFeB. Where appropriate, the magnet comprises a coating of Ni—Cu—Ni.

By way of example, the magnet body is embodied in the shape of a cube, rod, disc, sphere or ring. It is preferred the magnet body is embodied in the shape of a rotation body. By way of example, the magnet body is embodied in the shape of a cube that has an edge length of approx. 3 mm to 10 mm. By way of example, the magnet body is embodied in the shape of a rod or cylinder having a diameter of approx. 2 to 10 mm, preferably 4 mm and a height or length of approx. 5 to 20 mm, preferably 10 mm. Where appropriate, the magnet body is embodied as a disc having a diameter of approx. 10 mm and a thickness of approx. 5 mm. Where appropriate, the magnet body is embodied as a sphere having a diameter of approx. 4 to 7 mm. Where appropriate, the magnet body is embodied in the shape of a ring having a diameter of 10 mm and an inner open diameter of 5 mm.

It is preferred that the diameter is essentially constant over the extension of the magnet body so that a cylindrical peripheral surface is produced.

BRIEF DESCRIPTION OF THE SEVERAL VIEWS OF THE DRAWING

The invention is further described hereinunder with reference to specific exemplary embodiments and with reference to the figures.

DESCRIPTION OF THE INVENTION

FIG. 1 illustrates a building block in accordance with the invention having a base body 26 that is essentially cube-shaped. This base body is preferably embodied from multiple shells, in particular from two half shells 27. The building block 1 or rather the base body 26 comprises multiple faces 2. In the case of the cube-shaped design, the building block 1 comprises six faces 2.

Figure 1B:
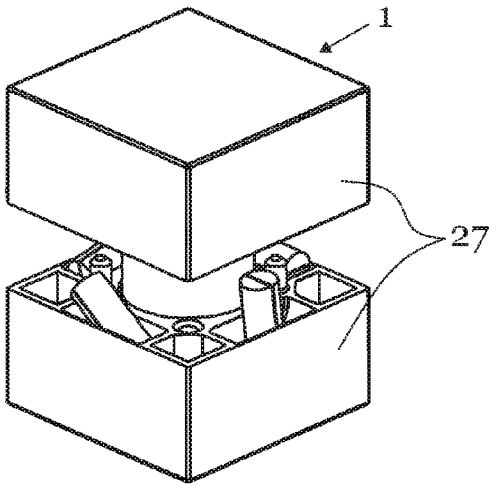
FIG. 1 illustrates multiple views of a building block that is embodied in the shape of a cube.
Figure 1D:
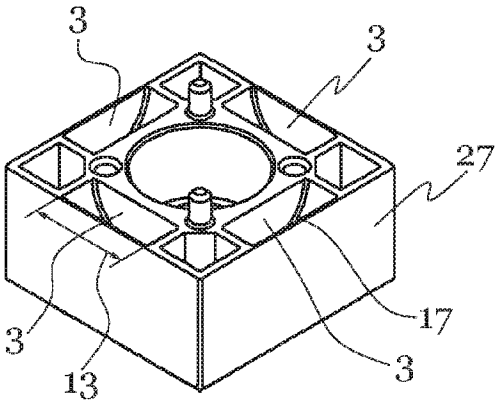
Figure 1A:
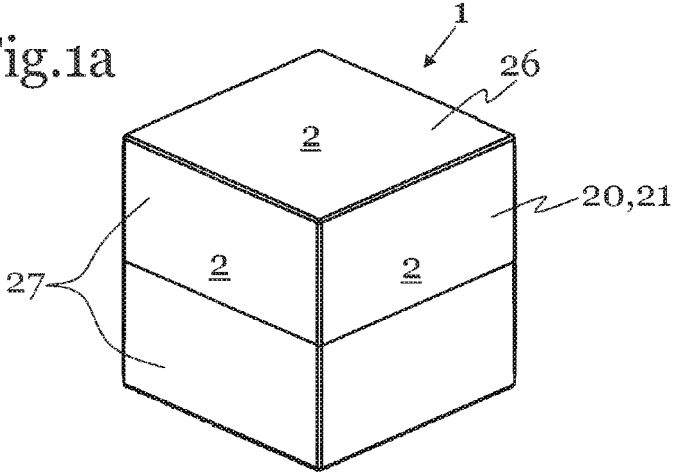
Figure 1C:
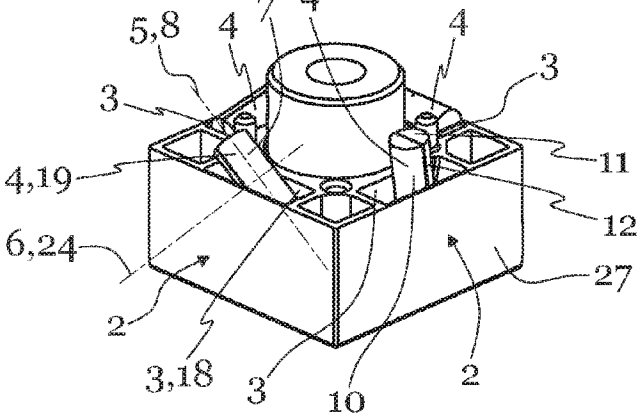

FIG. 1*a* illustrates the building block 1 in a ready-to-use and assembled position. The two half shells 27 are preferably connected to one another in a locked-manner manner, so that the desired shape of the building block is produced. It is preferred that the two half shells are connected to one another in a non-separable manner or that they can only be separated with considerable expenditure of effort so that the building block does not break down into individual parts during normal handling. The half shells can be connected in all embodiments by way of example by way of positive-locking or friction-type stud connections, by way of a materially-bonded connection such as weld connections or adhesive connections or other similar connections.

FIG. 1*b* illustrates the building block shown in FIG. 1, wherein the two half shells 27 are separate from one another. As a consequence, it is possible to describe the inner parts of the building block 1. However, this position does not correspond to any normal operating position. FIGS. 1*c* and 1*d* illustrate the two mutually separate half shells in individual views. FIG. 1*e* is a sectional view through the building block shown in FIG. 1.

In all the illustrations in FIG. 1, the building block 1 comprises faces 2 and also one or multiple magnet chambers 3. At least one magnet body 4 is provided in each case in the magnet chambers 3. The magnet body 4 comprises at least one, preferably two, axes of rotation. In the present embodiment, the magnet body 4 comprises an axis of rotation 5. The axis of rotation 5 corresponds essentially to the axis of rotation of the body 8 of the peripheral surface 7 that is embodied in the shape of a rotation body. In the present embodiment, the magnet body 4 comprises a further axis of rotation 6. This axis of rotation 6 is essentially perpendicular with respect to the axis of rotation 5. In particular, the axis of rotation 6 is arranged in a normal manner with respect to the closest face 2.

As is particularly also evident in FIG. 1*d*, the magnet chambers 3 comprises an essentially cylindrical shape. The axis of rotation 6 of the magnet body 4 corresponds essentially to the axis of rotation of the magnet chamber 3 that is embodied in a cylindrical shape.

The magnet body 4 comprises two poles 10, 11. The two poles extend in the case of the present embodiment preferably along the rotation body axis 8. The separation plane 12 of the two poles 10 and 11 extends thus along a longitudinal symmetrical plane of the magnet body that is embodied in the shape of a rotation body. Consequently, the rotation body axis 8 lies preferably in the separation plane 12 and in particular the rotation body axis 8 lies completely in the separation plane 12 of the two poles.

The diameter 13 of the cylindrical magnet chamber 3 is preferably greater than or equal to the dimension 9 of the magnet body 4 along the rotation body axis 8 of the magnet body or the peripheral surface. The height 14 of the cylindrical magnet chamber 3 is preferably greater than or equal to the diameter of the magnet body or the maximum diameter 15 of the magnet body. This maximum diameter corresponds to the maximum diameter of the magnet body, measured along an axis 16 that is perpendicular with respect to the rotation body axis of the magnet body.

In the present embodiment, magnet chambers or magnet bodies are provided on six faces 2 of the building block 1. A core 28 is provided in order to improve the mountability. This core 28 is inserted centrally between the two half shells 27, as a consequence of which two further magnet chambers 3 are formed and magnet bodies 4 are likewise provided in the two further magnet chambers 3. These magnet chambers 3 are also, where appropriate, embodied in the shape of a cylinder.

It is preferred that a chamber wall 17 is provided between the face 2 and the magnet chamber 3. The magnet chamber 3 is embodied in a closed manner by means of this chamber wall 17. In particular, all the magnet chambers 3 are closed with respect to the outside and this produces a closed building block.

FIG. 2 illustrates a building block 1 that is essentially embodied in the shape of a prism. In particular, the prism-shaped building block 1 comprises a triangular base face and a triangular top face, wherein the triangle is a right-angled isosceles triangle. The height of the prism corresponds essentially to the limb length of the right-angled isosceles triangle. As a consequence, two square-shaped faces 2 are produced. Moreover, a further face 2 is formed that is embodied in a rectangular manner. The longer side of this face corresponds to the hypotenuse length of the right-angled triangle. Moreover, the top face and the base face of the prism form triangular faces 2.

Figure 2A:
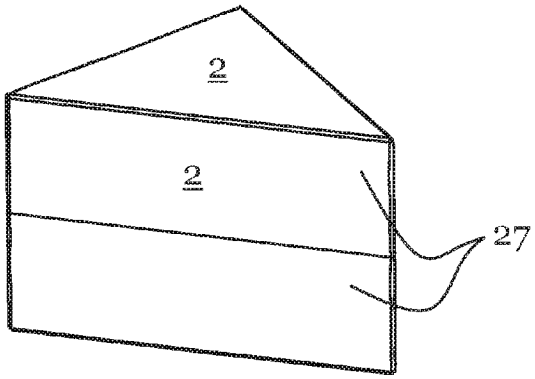
FIG. 2 illustrates multiple views of a building block that is embodied in the shape of a prism.

FIG. 2*a* illustrates the building block in the assembled, ready-to-use position. The two half shells 27 are essentially fixed to one another. In accordance with the preceding description, this connection is by way of example a friction-type connection, a positive-locking connection or a materially-bonded connection.

Figure 2C:
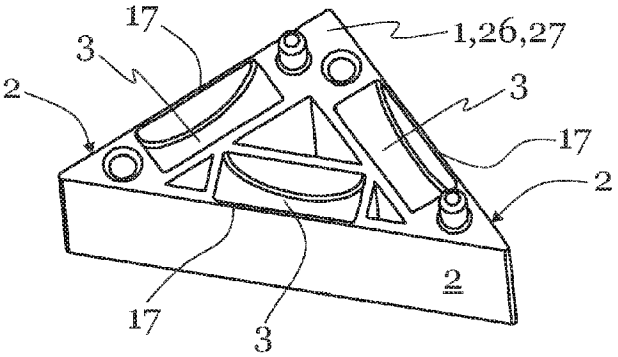
Figure 1E:
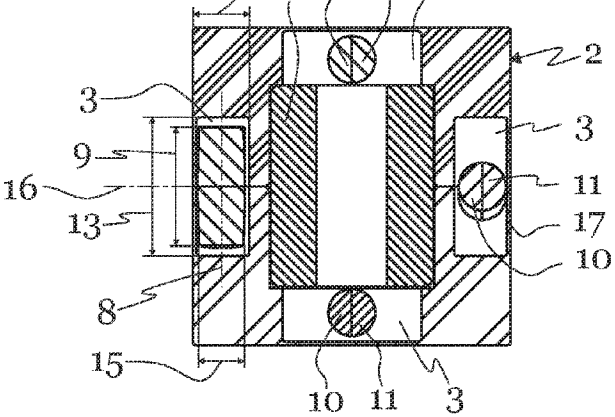
Figure 2B:
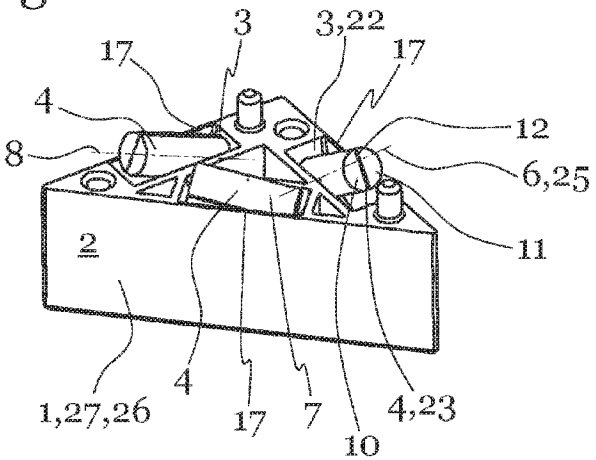

FIGS. 2*b* and 2*c* illustrate parts of a building block, wherein magnet chambers 3 are provided on the faces 2, in particular to the rear of the chamber wall 17. It is preferred that magnet bodies 4 or in each case one magnet body 4 is/are provided in the magnet chambers 3. The magnet body 4 of the embodiment of the FIG. 2 can correspond preferably to the magnet bodies shown in FIG. 1. The magnet chambers and the further features of this embodiment can also correspond to those shown in FIG. 1. It is preferred that the features that are common to FIG. 2 and FIG. 1 have the identical function and are of an identical design.

Fundamentally, the features of FIG. 1 and FIG. 2 are also produced in particular by means of the features of the list of reference numerals and by means of the general description part of the present application.

The following advantages in particular are achieved by means of the design in accordance with the invention:

Any face that has a magnet body lying behind it, in particular any rectangular or square-shaped face, of a first building block can be connected preferably to any face that has a magnet body lying behind it, in particular to any rectangular or square-shaped face, of a second building block.

This connection or the connection can preferably be performed in any desired rotational position or in any desired angle about a normal vector of the connected faces that lies in the region of the connection.

In the case of a connection of two building blocks, the faces that are mutually connected or are in contact with one another are penetrated by a magnetic field, in particular by a single magnetic field.

It is preferred that two building blocks are connected exclusively by means of a single pole of the magnet body of the one building block to a single opposite pole of the magnet body of the other building block.

The connection of two magnet bodies is performed where appropriate, not in a planar manner or in a spot manner but rather essentially in a linear manner, wherein by way of example two cylindrical magnet bodies that are operatively connected to one another in a parallel manner are connected essentially in a linear manner. As the one magnet body rotates, the other magnet body likewise automatically rotates as a result of magnetic forces.

It is preferred that the housing comprises two, three or a maximum three parts, wherein two parts can be embodied with an identical shape.

The total weight of the magnets is preferably less than the total weight of all housing parts and in particular than the total weight of the housing.

It is preferred that the specific weight of the building blocks amounts to less than 1 g/cm$^3$.

And this all leads likewise to the advantage that magnetic toy building blocks have the desired versatility in the case of greater holding forces and reduced costs, wherein by way of example at least 30 cube-shaped building blocks can be clipped to one cube-shaped building block.

LIST OF REFERENCE NUMERALS

1 Building block
2 Face
3 Magnet chamber
4 Magnet body
4 Axis of rotation of the magnet body
6 Axis of rotation of the magnet body
7 Peripheral surface that is embodied in the shape of a rotation body
8 Rotation body axis of the peripheral surface
9 Dimension of the magnet body along the rotation body axis
10 Pole of the magnet body
11 Pole of the magnet body
12 Separation plane of the two poles
13 Diameter of the cylindrical magnet chamber
14 Height of the cylindrical magnet chamber
15 Maximum diameter of the magnet body when measured in a perpendicular manner with respect to the rotation body axis
16 Axis that is arranged in a perpendicular manner with respect to the rotation body axis of the magnet body
17 Chamber wall
18 First magnet chamber
19 First magnet body
20 First building block
21 Second building block
22 Second magnet chamber
23 Second magnet body
24 Axis of rotation of the first magnet body
25 Axis of rotation of the second magnet body
26 Base body
27 Half shell
28 Core

The invention claimed is:

1. A building block, comprising:

at least one face delimiting the building block;

a building block interior;

a building block base body;

at least one magnet chamber;

at least one magnet body disposed in said at least one magnet chamber;

said at least one magnet body having a peripheral surface shaped as a rotation body or a cylinder, said at least one magnet body having a rotation body axis, said at least one magnet body having a greater dimension along said rotation body axis than perpendicular to said rotation body axis providing said at least one magnet body with an elongated shape;

said at least one magnet body having two poles, said poles having different magnetic polarities and said poles extending adjacent one another along said rotation body axis;

said at least one magnet body being mounted with appropriate clearance, guided and rotatable in said at least one magnet chamber about a two magnet body axes and being substantially blocked from further degrees of freedom of movement in said at least one magnet chamber;

one of said magnet body axes coinciding with said rotation body axis, said one magnet body axis extending parallel to said face being closest to said at least one magnet body, permitting one of said poles to rotate in a direction of said face and the other of said poles to rotate in a direction of said building block interior by rotating said at least one magnet body about said one magnet body axis as desired; and a chamber wall closing and separating said at least one magnet chamber from surroundings of the building block, said chamber wall being part of and formed in one piece with said building block base body.

2. The building block according to claim 1, wherein the two axes of the magnet body are perpendicular with respect to one another.

3. The building block according to claim 1, wherein the two poles each extend on one respective side of the rotation body axis of the magnet body as far as the outside of the magnet body so that the rotation body axis extends substantially between the two poles.

4. The building block according to claim 1, wherein an axis about which the magnet body can rotate in the magnet chamber coincides with the rotation body axis of the magnet body.

5. The building block according to claim 1, wherein the magnet chamber is embodied in the shape of a cylinder, wherein the axis of rotation of the cylindrical magnet chamber extends substantially in a normal manner with respect to the closest face, that a diameter of the cylindrical magnet chamber is greater than or equal to a maximum dimension of the magnet body along the rotation body axis of the magnet body, and that a height of the cylindrical magnet chamber is greater than or equal to a maximum diameter of the magnet body as measured in a perpendicular manner with respect to the rotation body axis of the magnet body so that the magnet body can rotate in the magnet chamber about its rotation body axis and about an axis that is perpendicular with respect to the rotation body axis.

6. The building block according to claim 1, wherein the magnet chamber is arranged in the interior of the building block close to a face, that a chamber wall is arranged between the magnet chamber and the face, wherein a magnetic field of the magnet body extends through the chamber wall and over and beyond the face as far as outside the building block.

7. The building block according to claim 1, wherein the magnet body can rotate at least 45°, 60°, 90°, 120°, 180°, 270° or 360° about an axis or that the magnet body can rotate about an axis in an unrestricted manner, and that the magnet body can rotate in an unrestricted manner or cannot rotate 45°, 60°, 90°, 120°, 180°, 270°, 360° about a second axis.

8. The building block according to claim 1, wherein the faces extend or are planar in each case along one plane.

9. The building block according to claim 1, wherein at least one face is square-shaped.

10. The building block according to claim 1, wherein two or more square-shaped faces are arranged in pairs in an orthogonal manner with respect to one another so that the building block is embodied in a shape of a cube or in a shape of a part of a cube, or a right prism that includes a base face in a shape of a right-angled isosceles triangle whose limb length corresponds to a height of the prism.

11. The building block according to claim 1, wherein multiple magnet chambers are each provided with one respective magnet body or a respective magnet chamber having one magnet body is provided on each of multiple faces.

12. The building block according to claim 1, wherein a respective magnet chamber having one magnet body is provided on each face or on faces each being square-shaped.

13. The building block according to claim 1, wherein an axis of rotation of the magnet body in the magnet chamber extends substantially in a normal manner with respect to the closest outer face and where appropriate this axis of rotation extends in a perpendicular manner with respect to the rotation body axis of the magnet body.

14. The building block according to claim 1, wherein the magnet chamber is separated in a water-tight manner so that one building block is formed with a magnet chamber that is substantially sealed with respect to outside surroundings or is formed with multiple magnet chambers that are substantially sealed with respect to the outside.

15. A building block system comprising two or more building blocks according to claim 1, wherein:

a first building block includes a first magnet chamber having a first magnet body that is provided in the first magnet chamber in such a manner as to be able to rotate, a second building block includes a second magnet chamber having a second magnet body that is provided in the second magnet chamber in such a manner as to be able to rotate, and the first building block can be connected or is connected to the second building block by way of magnetic forces that act between the first magnet body and the second magnet body.

16. The building block system according to claim 15, wherein an axis of rotation of the first magnet body in the first magnet chamber of the first building block coincides with an axis of rotation of the second magnet body in the second magnet chamber of the second building block so that two building blocks that are connected by way of the first magnet body and the second magnet body can rotate with respect to one another whilst maintaining a constant magnetic holding force and can rotate in a centered manner with respect to one another.

17. The building block system according to claim 15, wherein multiple building blocks can each be connected or are connected to one another by way of respective multiple magnet bodies that are provided in the magnet chambers.

18. The building block system according to claim 15, wherein two or more building blocks of the building block system are embodied with an identical shape.

19. The building block system according to claim 15, wherein the magnet bodies of two mutually connected faces of two building blocks each point outwards with only a respective one of their poles, wherein the outwards-pointing pole of one building block and the outwards-pointing pole of the other building block have an opposite polarity, and that an orientation of the two magnet bodies is produced automatically by the magnetic forces of the magnet bodies.

* * * * *